US005079826A

United States Patent [19]

Ercums et al.

[11] Patent Number: 5,079,826

[45] Date of Patent: Jan. 14, 1992

[54] WIRE CUTTING AND REMOVAL APPARATUS

[75] Inventors: Waldemar M. Ercums, Olympia; Larry M. Johnson, Aberdeen; Norman E. Dornblaser, Elma; Stephen K. Hood, Hoquiam, all of Wash.

[73] Assignee: Lamb-Grays Harbor Co., Hoquiam, Wash.

[21] Appl. No.: 524,222

[22] Filed: May 15, 1990

[51] Int. Cl.[5] ..... B23P 19/00; B65B 69/00

[52] U.S. Cl. ..... 29/564.3; 29/426.4; 225/93; 83/176; 83/909

[58] Field of Search ..... 29/426.4, 564.3; 83/909, 924, 100, 160, 651, 697; 30/346, 346.55, 346.61; 225/93

[56] References Cited

U.S. PATENT DOCUMENTS

| | | | |
|---|---|---|---|
| 303,855 | 8/1884 | Hunt | 30/346 |
| 385,914 | 7/1888 | Curley | 30/346 |
| 2,711,109 | 6/1955 | Gillstrom | 225/93 |
| 2,820,282 | 1/1958 | Schneider, Jr. . | |
| 2,845,706 | 8/1958 | Aciego | 30/346 |
| 3,146,654 | 9/1964 | Mathews et al. . | |
| 3,513,522 | 5/1970 | Thompson | 83/909 |
| 4,250,783 | 2/1981 | Ogle et al. | 83/397 |
| 4,261,395 | 4/1981 | Gronau | 83/909 |
| 4,328,609 | 5/1982 | Born | 83/909 |
| 4,680,850 | 7/1987 | Boucherie | 29/426.3 |
| 4,718,157 | 1/1988 | Keyzers et al. | 29/426.4 |
| 4,773,148 | 9/1988 | Ohya et al. | 29/564.3 |
| 4,831,713 | 5/1989 | Hodén | 29/564.3 |
| 4,835,836 | 6/1989 | Van Uitert | 29/564.3 |
| 4,841,619 | 6/1989 | Thériault | 29/426.4 |
| 4,873,759 | 10/1989 | Burch | 83/176 |

FOREIGN PATENT DOCUMENTS

| | | | |
|---|---|---|---|
| 3042025 | 7/1982 | Fed. Rep. of Germany | 83/651 |
| 9000498 | 1/1990 | World Int. Prop. O. | 83/909 |

*Primary Examiner*—David Jones
*Attorney, Agent, or Firm*—Seed and Berry

[57] ABSTRACT

A roller conveyor supports a bale at a cutting and removing station. Side compactors and a top compactor compress the bale slightly for positioning it. The bale is pushed against a wire cutting channel in which a blade having a surface that protrudes into and forms a groove in the bottom surface of the bale is passed diagonally across the bale, with the wires springing into a recess in the blade. The blade continues to move, pulling the wire against the back wall of the recess until the wire exceeds its tensile strength and breaks. The bale is then lifted on pins so that a wire pulling blade can be moved also diagonally across the top of the bale. The pulling blade also has a forwardly inclined surface that pushes the bale down while allowing the wires to be captured in a recess in the blade. The blade is moved across the bale, capturing all of the wires and removing them from the bale. Another embodiment uses a turner to rotate the bale to cut and remove wires from adjacent sides of the bale.

17 Claims, 6 Drawing Sheets

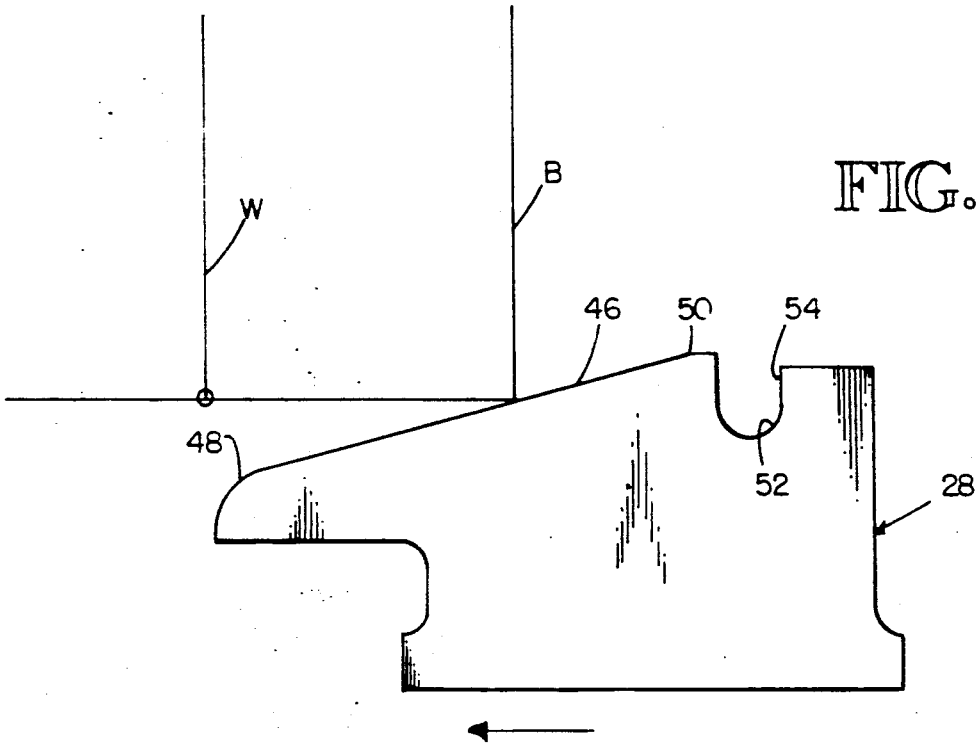
FIG. 3
FIG. 4
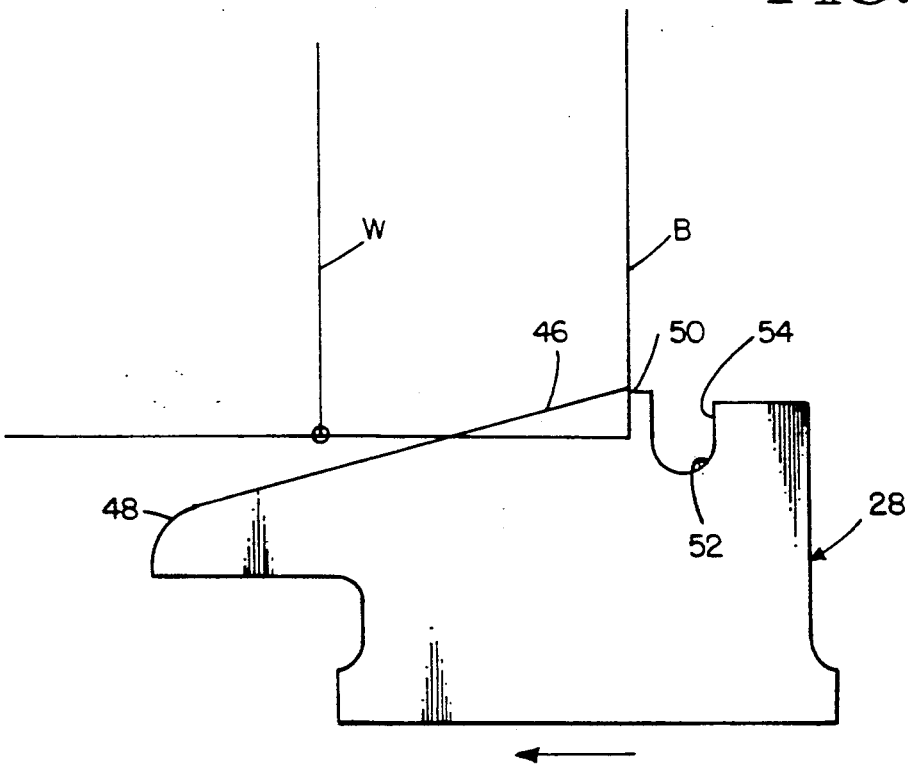

WIRE CUTTING AND REMOVAL APPARATUS

DESCRIPTION

1. Field of the Invention

This invention pertains to apparatus for cutting or breaking through wires or the like tightly wrapped around a compressible object such as a pulp bale.

2. Background of the Invention

Compressible bales, such as pulp bales or bales of compressible waste materials such as shredded paper, newspaper, or corrugated cardboard, are tightly strapped most often with baling wire that indents into the bale and is thus hard to access for the purposes of cutting the wire. It is desirable when cutting this wire not to penetrate the bale so as to cause damage to the bale, or have the fiber contents of the bale collect on the cutting surfaces of the wire cutter and impede or hinder the cutting operation. Various techniques for cutting the wires have been tried in the past. One technique uses snippers that cuts each individual wire on the bale. As is well known, the bale is generally tied with two wires around each direction of the bale. Thus, with the bale having four wires the use of individual snippers results in a complicated cutting mechanism.

SUMMARY OF THE INVENTION

This invention pertains to an improved wire cutting and removing apparatus, particularly usable with generally cubic compressible bales such as pulp bales tightly bound with wire. In this invention, a cutting blade travels along one face of the bale and a wire removing blade travels along the other opposite face of the bale. The cutting blade is uniquely shaped to allow the wire to be separated or spaced slightly from the surface of the bale, until the wire is engaged by the cutting surface of the blade. Preferably, the blade is not sharpened (although it may be sharpened), so that it has longer life and breaks the wire rather than notches or otherwise cuts the wire. The wire removing blade similarly has a surface to separate the wire from the surface of the bale sufficient for the wire to fall into a notch which then traps the wire as the blade is moved across the surface of the bale. Finally, the wire collected is coiled for disposal in a known manner.

In one embodiment the wire cutting blade travels along a diagonal path across the bale and the wire pulling blade travels along a second diagonal approximately at right angles to the cutting blade path. In a second embodiment the cutting blade and the pulling blade paths are approximately vertically aligned at the center of the bale and travel in a horizontal direction perpendicular to the bale feed path. In this embodiment, only the wires parallel to the bale feed direction are removed, the bale is then rotated 90° and the remaining wires are similarly removed.

The blades are each provided with a forward surface inclined from a forward end extending beyond the plane or surface of the object on which the wire rests to a rearward end extending inwardly of the plane of the surface of the object on which the wire rests. The wire cutting or breaking blade has a wire hooking recess rearward of the forward surface for hooking the wire, and during movement of the blade across the bale, the forward sloped surface (surface 46, FIG. 3) of the blade indents the bale and forces the wire into the indentation as the blade crosses the wire. As the notch (52, FIG. 3) passes the wire, the wire tension pulls the wire into the notch. As the blade continues across the bale, the rearward surface of the notch (54, FIG. 3) catches the wire, tensioning the wire until it exceeds its tensile strength and breaks. The movement is in a direction parallel to the plane of the surface of the object on which the wire rested.

The wire removing blade also has a similar inclined forward surface. A wire grasping recess is positioned rearwardly of the forward surface for grasping the wire and pulling it parallel to the surface of the object on which the wire was resting for removing the wire.

The wire breaking blade is moved by a linear hydraulic cylinder and the wire removing blade is moved by a chain and sprocket drive although other types of moving mechanisms could be used.

The use of these unique blades with their powered linear movement provides a simple, low-maintenance apparatus which can cut and remove all of the wires without doing significant damage to the bale.

BRIEF DESCRIPTION OF THE DRAWINGS

FIGS. 3–5 are schematic illustrations showing the movement of a wire cutting or breaking blade along the bale to catch and break a wire.

DETAILED DESCRIPTION OF THE INVENTION

Figure 1:
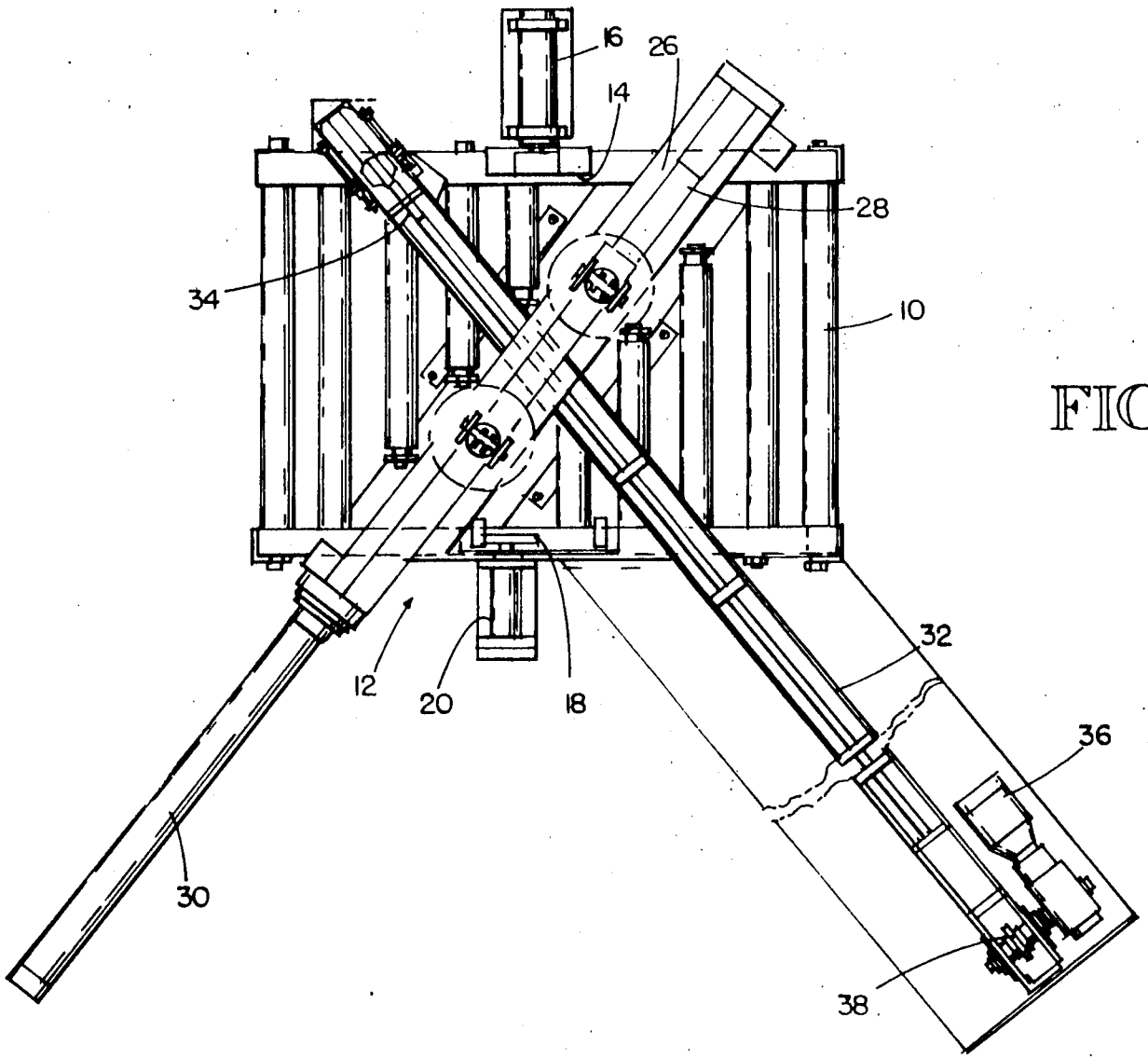
FIG. 1 is a schematic plan of a typical wire cutting and removal apparatus embodying the principles of the invention.
Figure 2:
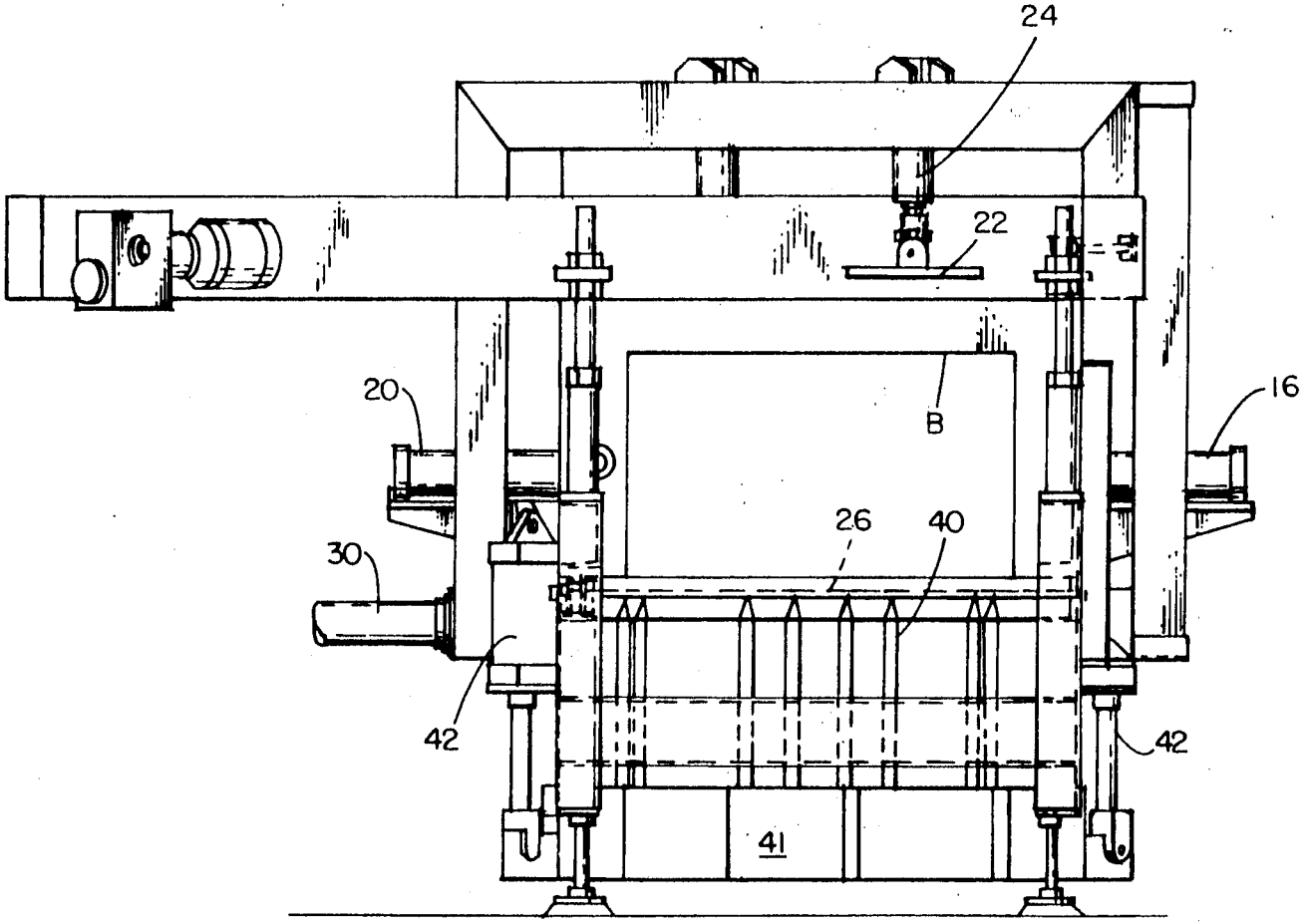
FIG. 2 is an end elevation of the apparatus.

As best shown in FIGS. 1 and 2, a powered roller conveyor 10 moves a bale B to a wire removing station 12 in a conventional manner. At the wire removing station, a compactor 14 powered by a hydraulic cylinder 16 shifts the bale to one side and centers the bale between the wire cutting and removing mechanisms. A second compactor 18 powered by a hydraulic cylinder 20 helps to guide the bale into its aligned position. The compactors 14 and 18 hold the bale while the wire cutting occurs.

A vertical compactor plate 22 (FIG. 2) is powered by a hydraulic cylinder 24 to press the bale downwardly onto a wire cutting channel 26. A breaking blade 28 that is moved linearly by a hydraulic cylinder 30 is located within the channel 26.

Located above the conveyor is a wire removing channel 32 having a wire pulling or removing blade 34 connected to a chain and sprocket 38 driven by a gear motor 36.

As is best shown in FIG. 1, the wire cutting channel 26 and the wire removing channel 32 are crisscrossed diagonally over the bale B. In this manner, the wire cutting blade and the wire removing blade will both travel from right to left in FIG. 1 across the entire diagonals of the bale such that they will engage each of the wires on the bale whether there are two wires in one direction, or pairs of wires in opposite directions. It is understood that one set of wires will be wrapped over the top, along the sides, and around the bottom of the bale and a second set will be similarly wrapped around the bale at right angles to the first set as is well known.

Located beneath and between the conveyor rollers are a plurality of lifter pins 40 that are arranged to engage the bottom surface of the bale at spaced locations throughout its bottom surface. A frame 41 supports the pins and is raised and lowered by a hydraulic cylinder 42.

The wire breaking blade 28 is best shown in FIG. 3, and includes an inclined surface 46 having a forward end 48 that extends laterally outwardly beyond the surface of the bale on which the wire is resting to a rearward end 50 that extends internally of the plane of the bale in which the wire is resting. The inclined surface 46 terminates in a U-shaped breaking recess 52. The rear wall 54 of the recess is shorter than the opposite wall of the recess. This allows the wire to drop into the recess but the rear edge of the recess will be less likely to engage the surface of the bale. Thus it will be less likely to have the bale be torn by the rear wall of the recess 54, since the corner of the rear wall of the recess rides in a groove 53 made by the rearward end 50 of the inclined surface 46.

As best shown in FIG. 3, the surface 46 is beginning to engage the surface of the bale B approaching a wire W.

In FIG. 4 the surface 46 begins to form a crease in the surface of the bale as it continues movement toward the wire.

Figure 5:
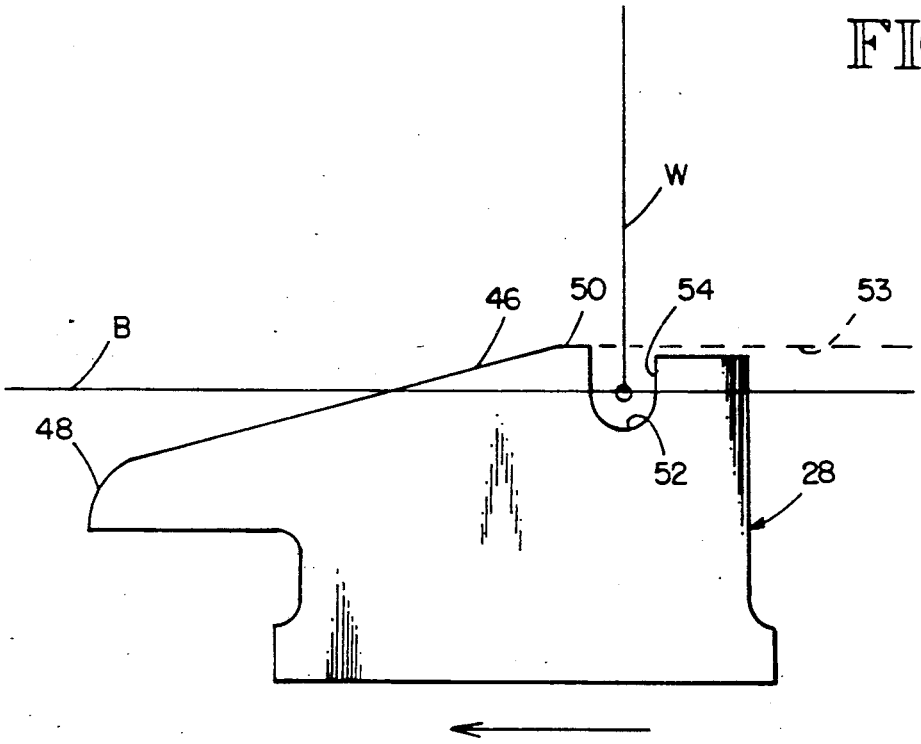

In FIG. 5 the blade has advanced until the wire has dropped into the recess and becomes pulled by the rear wall 54 of the recess. The space above the shortened rear wall allows the rear wall of the recess to pass unimpeded through the groove 53 formed by the inclined surface. The blade continues with the blunt pulling surface of the wall 54 pulling and stretching the wire until it exceeds its tensile strength and snaps. The blunt edge advantageously breaks the wire thereby relieving the tension in the wire, making it possible for the wire removing blade to remove the broken wire, and eliminates the need for sharpening the rear wall of the recess.

Figure 6:
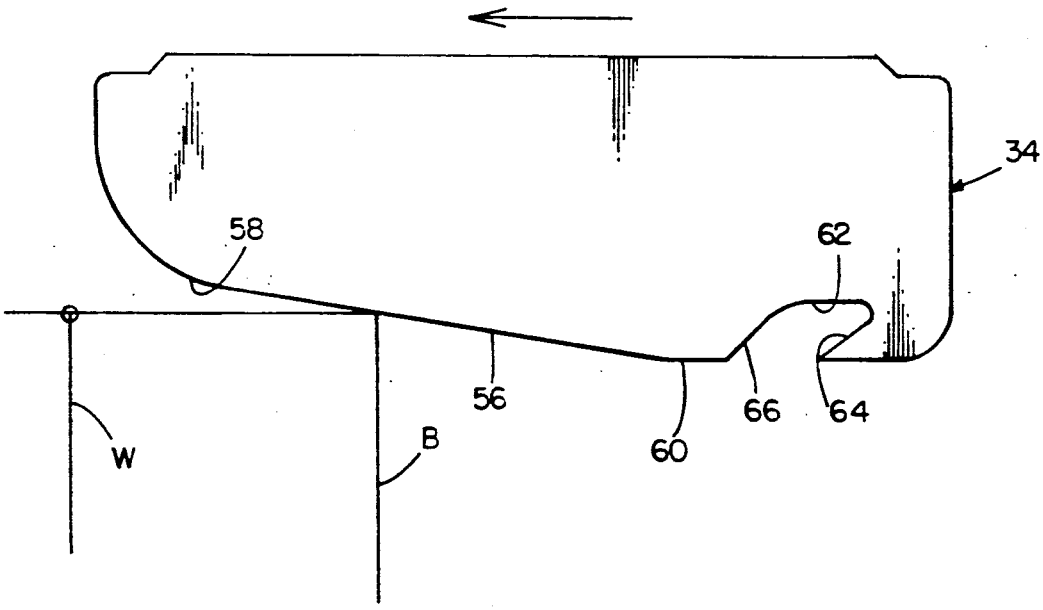
FIGS. 6–8 are schematic illustrations of a wire removing or pulling blade showing its path along the surface of the bale to catch and pull a wire from the bale.

FIG. 6 illustrates a similar movement of the pulling or wire removing blade 34. The removing or pulling blade has an inclined surface 56 having a forward end 58 that extends laterally outwardly beyond the plane of the surface of the bale upon which the wire is resting. The inclined surface extends to a rearward end 60 that extends laterally inwardly of the plane of the surface of the bale upon which the wire is resting. A recess 62 is positioned behind the inclined surface and has a rear wall 64 at a forwardly and inwardly sloping angle relative to the bale and a forward wall 66 having the same angle. This recess allows the wire to slide into the recess and be captured by the rear wall 64 as the blade moves along the bale.

Figure 7:
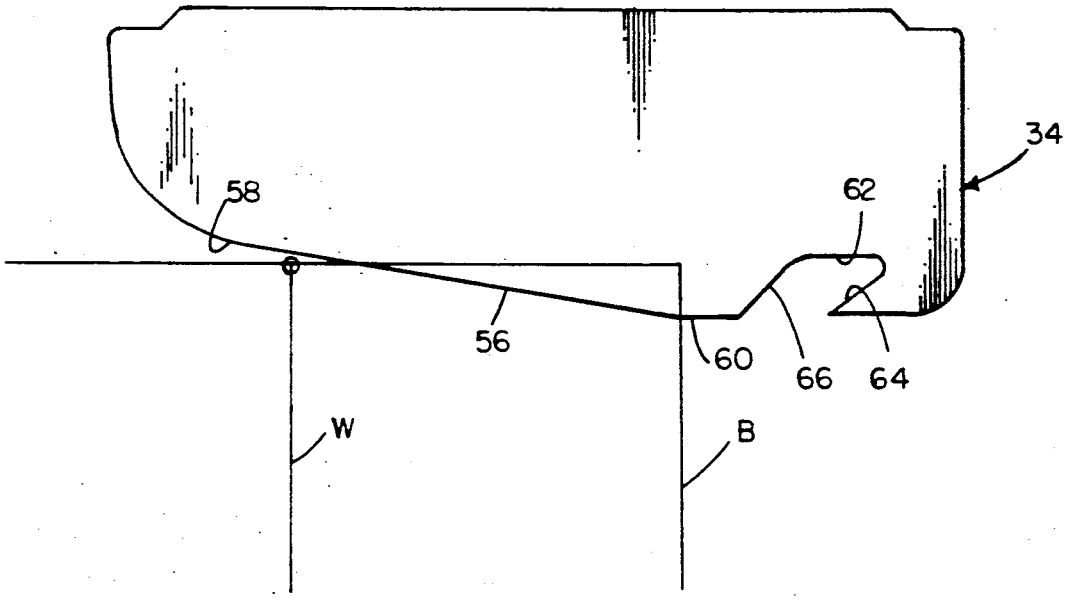

FIG. 7 shows the blade engaging the bale, forming a groove to allow the wire to be separated from the surface of the bale.

Figure 8:
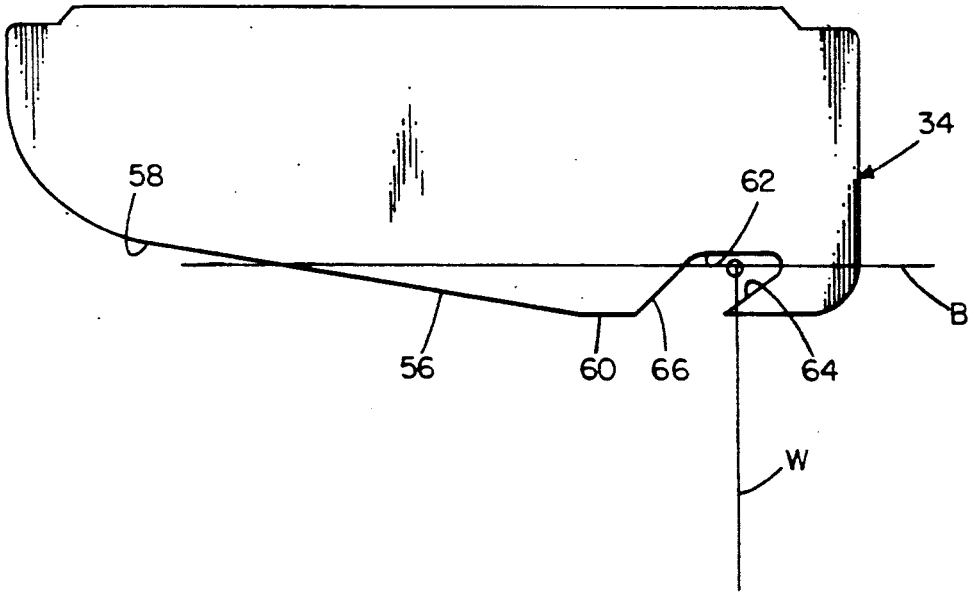

FIG. 8 shows the wire having moved into the recess 62 and be trapped such that additional movement forwardly of the blade will capture the wire and pull it from around the bale.

In operation a bale is conveyed to the wire cutting and removing station. The side compactors push the bale to one side of the conveyor but centering the bale between the cutting blade channel 26 and the wire removing blade channel 32. The top compactor presses the bale downwardly against the wire cutting channel. The cutting blade is then moved diagonally across the bale, breaking all of the wires. Next, the compactors are retracted and the pins are raised to lift the bale off the roller conveyor. This provides a space for allowing the wires to be pulled from beneath the bale by the wire pulling blade, which is then pulled across the top of the bale. Preferably, the wire will then be captured by a wire coiler and discarded.

Figure 9:
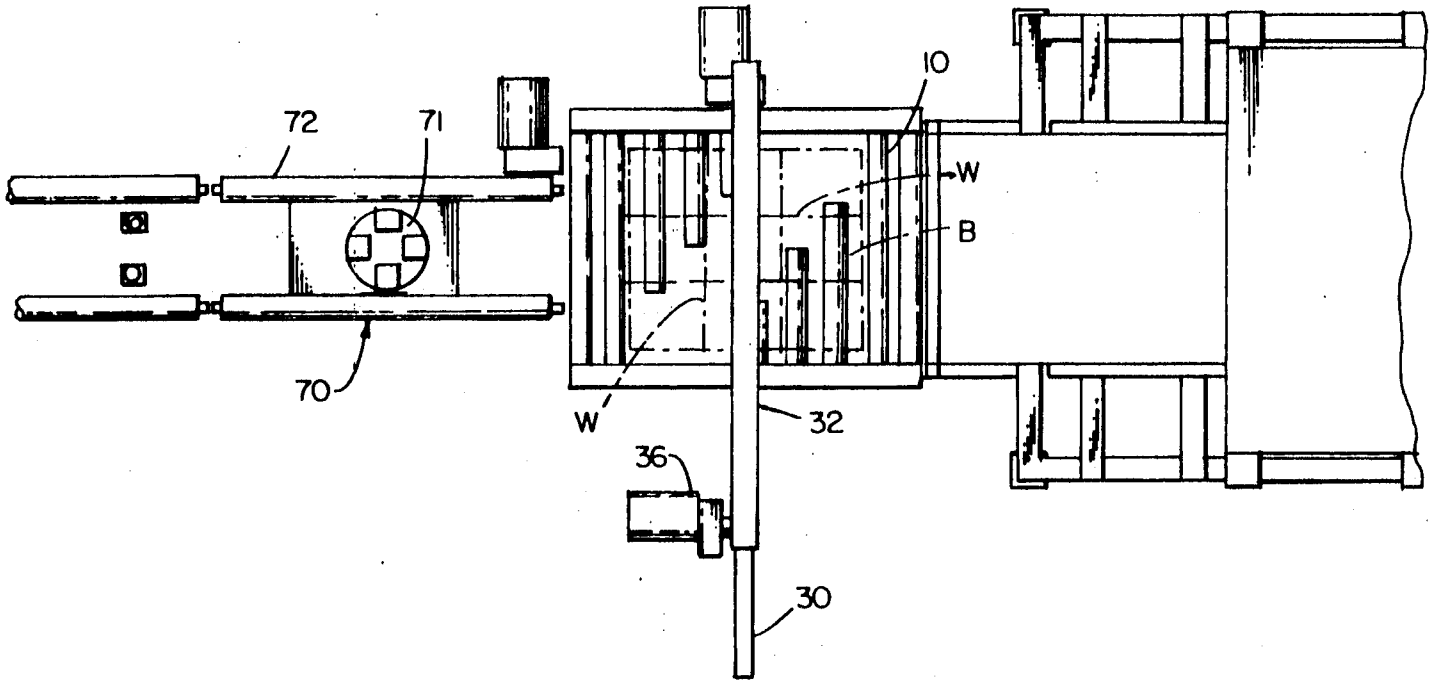
FIG. 9 is a schematic plan of another embodiment.

In the embodiment of FIG. 9, the wire cutting blade channel is below and vertically aligned with the wire pulling blade channel 32. The wire cutting blade is moved by the cylinder 30 and the wire pulling blade is pulled by its chain and sprocket drive 36 as in the first embodiment. In this embodiment, however, the bale must be rotated ninety degrees to remove the second set of wires on the other sides of the bale because the channels are not diagonal to the bale. For this purpose, a conventional bale turner table 70 having a turner 71 and reversible conveyor 72 is positioned next to the conveyor 10.

In operation of the embodiment of FIG. 9, the bale has wires from one side removed, then is moved by the conveyor 10 to the table 70. The bale is rotated by the table and moved back onto the conveyor 10 where the cutting and removing cycle is completed to remove the remaining set of wires wrapped at right angles to the first set.

Any combination of cutting and removing mechanisms and bale turning apparatus may be employed. For example, the wires can be cut and removed at a first cutting and removing station from one side as in FIG. 9, the bale removed and turned ninety degrees and then advanced to a separate second cutting and removing station while a new bale is advanced to the first station.

While the preferred embodiments of the invention have been illustrated and described, it should be understood that variations will be apparent to one of ordinary skill in the art. Accordingly, the invention is not to be limited to the specific embodiments illustrated in the drawing.

We claim:

1. Apparatus for removing sets of wires or strapping members wrapped around large generally compressible objects such as bales, comprising:

a conveyor for moving the wired object to a wire cutting and removing station;

a compactor at the station to press the object down on the conveyor;

a breaking mechanism movable across one plane of the object to break the wires, said breaking mechanism including a breaking blade having a forward surface inclined from a forward end extending laterally outwardly beyond the plane of the surface of the object on which the wires rest to a rearward end extending inwardly of the plane of the surface of the object on which the wire rests, a wire hooking recess rearward of the forward surface for hooking the wire and means for moving the breaking blade in a direction parallel to the plane of the surface of the object on which the wire rested until the wire is broken, and;

means for removing the broken wire from the object.

2. The apparatus of claim 1, said means for removing the wire including:

a pulling blade having a forward surface inclined from a forward end extending beyond the plane of the surface of the object on which the wire rests to a rearward end extending inwardly of the plane of the surface of the object on which the wire rests, a wire grasping recess for grasping the wire, and means for pulling the wire pulling blade parallel to the plane of the surface of the object on which the wire was resting for hooking and removing the wire.

3. The apparatus of claim 2, including:

means for lifting the object off the conveyor when the wire is pulled off the object.

4. The apparatus of claim 1, said wire hooking recess being defined by a forward wall and a blunt rearward wall terminating lengthwise toward the object a distance less than said recess forward surface.

5. The apparatus of claim 2, said recess on said wire pulling blade having a forward inclined wall, an inner intermediate surface joining said forward inclined wall and terminating at a rearward inclined wall, said blade recess inclined wall being inclined from the open end of the recess rearwardly and away from the object.

6. The apparatus of claim 2, said breaking mechanism including a breaking channel for guiding the wire breaking blade, disposed along a diagonal relative to the object, said wire removing means including a removing channel for guiding the wire removing blade disposed along a diagonal relative to the object and approximately at right angles to the breaking channel.

7. The apparatus of claim 2, said breaking mechanism including a breaking channel for guiding the wire breaking blade disposed along a transverse path relative to the object, said wire removing means including a removing channel for guiding the wire removing blade disposed along the same general transverse path generally vertically aligned with the breaking channel, and object turning means for receiving an object with one set of wires on one side removed, turning the object ninety degrees and moving the object to the cutting and removing stations again for removal of the set of wires on the opposite sides of the object.

8. A wire breaking and removing apparatus for a compressible bale having multiple wires wrapped around the bale, comprising:

a conveyor;

a breaking channel aligned at a generally diagonal angle across the conveyor;

means for pressing the bale against the breaking channel;

a wire breaking blade movable along the breaking channel, said breaking blade having a forward surface inclined from a forward end extending beyond the plane of the surface of the object on which the wire rests to a rearward end extending inwardly of the plane of the surface of the object on which the wire rests, a wire hooking recess rearward of the forward surface for hooking the wire, and means for moving the blade in a direction parallel to the plane of the surface of the object on which the wire rested for tensioning the wire to failure, and;

means for removing the cut wire.

9. The apparatus of claim 8, including:

a wire removing channel aligned at a generally diagonal angle across the conveyor and at approximately a right angle to the breaking channel;

a wire pulling blade moveable along the wire removing channel, said wire pulling blade having a forward surface inclined from a forward end extending beyond the plane of the surface of the object on which the wire rests to a rearward end extending inwardly of the plane of the surface of the object on which the wire rests, a wire grasping recess for grasping the wire, and means for pulling the pulling blade parallel to the plane of the surface of the object on which the wire was resting for removing the wire.

10. A blade for use in a wire breaking and removing apparatus movable in a direction parallel to the plane of the surface on which a wire rests, said blade having a forward contact surface inclined from a forward end extending beyond the plane of the surface of the object on which the wire rests to a rearward end extending inwardly of the plane of the surface of the object on which the wire rests, the object having a compressible material, a wire receiving recess for hooking the wire and for tensioning the wire to failure when the blade is moved in a direction parallel to the plane of the object on which the wire rested, wherein the blade is a wire breaking blade, said wire receiving recess having a blunt rear wall having an angle at least perpendicular to the forward direction of travel of the blade when breaking a wire, and a forward wall relative to the direction of movement of the blade when breaking a wire, the rear wall being shorter in the direction perpendicular to said forward contact surface than said forward wall of the recess and said inclined forward contact surface terminating at the longer forward wall of the recess so that the forward contact surface adjacent the forward wall of the recess extends toward the object further than the rear wall of the recess to shield the recess from receiving material of the object.

11. The blade of claim 10 wherein the blade is a wire cutting blade, said wire receiving recess having a rear wall and a forward wall, the rear wall being shorter in the direction perpendicular to the surface of the bale upon which the wire will rest than said rear wall of the recess and said rearward end of the inclined forward surface.

12. The blade of claim 10 wherein the blade is a wire pulling blade, said wire receiving recess having a rear wall and a forward wall both inclined forwardly and inwardly relative to the blade.

13. A wire or other strap breaking and removing apparatus for a compressible bale having multiple wires wrapped around the bale, comprising:

a conveyor;

a breaking blade movable past the conveyor and against the bale, said breaking blade having a forward surface inclined from a forward end extending beyond the plane of the surface of the object on which the wire rests to a rearward end extending inwardly of the plane of the surface of the object on which the wire rests, said breaking blade having a generally blunt hooking recess along the forward surface for hooking the wire, and means for moving the blade in a direction parallel to the plane of the surface of the object on which the wire rests for compressing the bale with the forward surface and then hooking the wire in the recess and tensioning the wire to failure, and;

means for removing the cut wire.

14. The wire breaking and removing apparatus of claim 13, including:

a wire removing channel over the conveyor;

a pulling blade moveable along the wire removing channel, said wire pulling blade having a wire grasping recess for grasping the wire, and means for pulling the pulling blade parallel to the plane of the surface of the object on which the wire is resting for engaging the wire in the recess and removing the wire.

15. The breaking and removing apparatus of claim 13 including a breaking channel aligned at a generally diagonal angle across the conveyor, said breaking blade being slidably carried in said cutting channel.

16. The breaking and removing apparatus of claim 14, including a breaking channel aligned at a generally diagonal angle across the conveyor, said breaking blade being slidably carried in said breaking channel, said wire removing channel also aligned at a generally diagonal angle across the conveyor and at a generally perpendicular angle to said wire breaking channel.

17. A wire breaking and removing apparatus for a compressible bale having multiple wires wrapped around the bale, comprising:

a wire breaking blade movable along the bale;

a generally blunt wire hooking recess for hooking the wire, the wire hooking recess defined by a forward wall extending outwardly a distance further than a rear wall to compress the bale ahead of the recess, and means for moving the blade in a direction parallel to the plane of the surface of the bale on which the wire rested for pushing the wire and bale surface inwardly forward of the recess but allowing the wire to snap into the recess as the recess aligns with the wire to engage the wire with the rear wall of the recess for tensioning the wire to failure; and means for removing the cut wire.

* * * * *